United States Patent [19]

Warning, Sr. et al.

[11] 4,098,915

[45] * Jul. 4, 1978

[54] METHOD FOR CONTROLLABLY APPLYING LIQUIDS TO A MOVING SURFACE

[75] Inventors: Walter B. Warning, Sr., Chicago; Walter B. Warning, Jr., Schaumburg, both of Ill.

[73] Assignee: Airprint Systems, Inc., Itasca, Ill.

[ * ] Notice: The portion of the term of this patent subsequent to Mar. 22, 1994, has been disclaimed.

[21] Appl. No.: 756,415

[22] Filed: Jan. 3, 1977

Related U.S. Application Data

[62] Division of Ser. No. 562,679, Mar. 27, 1975, Pat. No. 4,013,037.

[51] Int. Cl.[2] ..... B05D 1/04; B05B 12/00

[52] U.S. Cl. ..... 427/8

[58] Field of Search ..... 427/8, 9, 10

[56] References Cited

U.S. PATENT DOCUMENTS

| | | | |
|---|---|---|---|
| 3,649,340 | 3/1972 | Mozzi | 427/8 X |
| 4,032,670 | 6/1977 | Warning et al. | 427/8 |

FOREIGN PATENT DOCUMENTS

| | | | |
|---|---|---|---|
| 811,795 | 4/1959 | United Kingdom | 427/8 |

*Primary Examiner*—James R. Hoffman

*Attorney, Agent, or Firm*—Edmond T. Patnaude

[57] ABSTRACT

A servo motor is mounted to a liquid spray head and operated by a speed sensing control means to automatically control the liquid flow rate from the head in proportion to the speed at which a surface to be sprayed passes said head.

1 Claim, 3 Drawing Figures

METHOD FOR CONTROLLABLY APPLYING LIQUIDS TO A MOVING SURFACE

This is a Divison of application Ser. No. 562,679, filed Mar. 27, 1975, now U.S. Pat. No. 4,013,037.

The present invention relates in general to the art of controlling the application of a liquid, such as glue, to a predetermined surface area, and it relates more particularly to a new and improved system for automatically controlling the operation of a spray head to apply a constant quantity of liquid to a surface passing the spray head at an irregular speed and to apply said liquid only to a predetermined area or areas on said surface.

BACKGROUND OF THE INVENTION

It has recently become known that cold liquid glue can be applied to a surface by means of an atomizing spray head. To be effective the amount of glue applied must be very small as compared to that used with other systems and the amount of glue applied must be controlled within narrow limits. For high speed applications such as in box making where the folded boxes travel through the gluing station at speeds as high as three hundred feet per minute but at times at considerable lower speeds, substantial variations in the quantity of glue layed down has resulted. Consequently, unsatisfactory joints have sometime occurred.

It is common practice in the box and package making industry to use the same equipment for different types and sizes of boxes thus requiring setup of the associated gluing systems each time the line is changed over from one size or shape of box to another or when the speed of the line is changed. This has resulted in a considerable amount of machine downtime.

SUMMARY OF THE INVENTION

In accordance with one aspect of the present invention means are provided for controlling the volume of liquid emitted from a spray head in proportion to the speed at which the surface to be sprayed passes the spray orifice. In a preferred embodiment of the invention this control means includes a motor mounted to the spray head for adjusting the orifice size in response to the speed at which the surface to which the liquid is to be applied passes the spray orifice.

In accordance with another aspect of this invention means are provided for controlling the initiation and termination of a spray cycle in response both to the sensing of an article to be sprayed and to the speed at which the article is moving past the spray head. With this system, variations in the conveyor speed do not affect either the position or area where the liquid is applied.

BRIEF DESCRIPTION OF THE DRAWINGS

Further objects and advantages and a better understanding of the present invention can be had by reference to the following detailed description wherein.

DETAILED DESCRIPTION OF THE INVENTION

Figure 1:
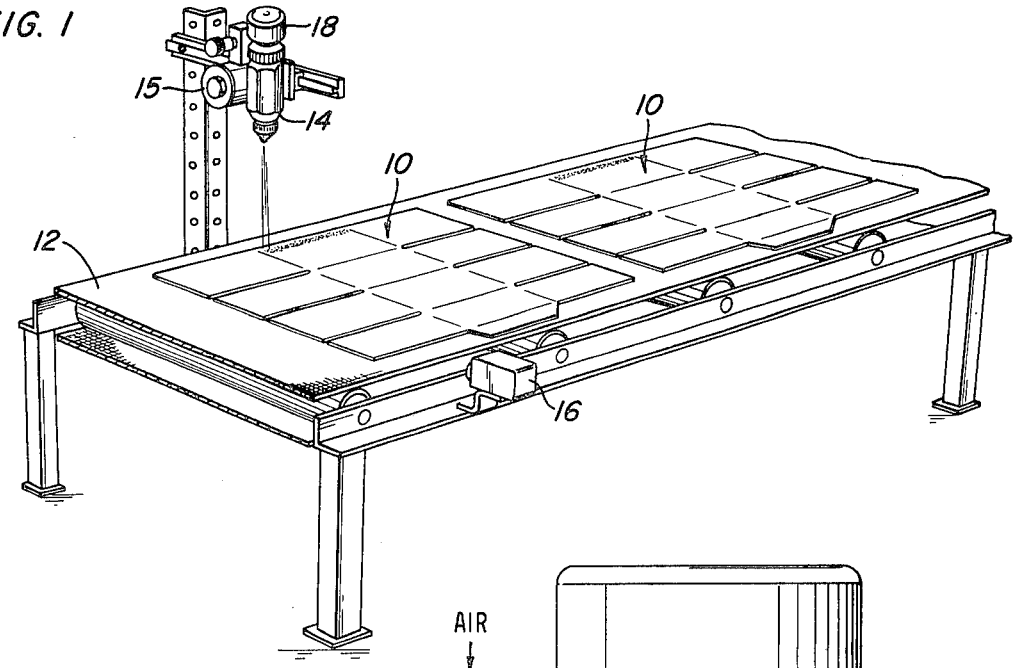
FIG. 1 is a perspective view of the glue applying station of a box assembly line.

Referring now to the drawing and particularly to FIG. 1 thereof, a plurality of open boxes 10 are transported by a traveling belt or conveyor 12 past a spray head 14 which directs an atomized liquid glue spray onto the flaps of each box as it travels thereby. The flaps are subsequently closed, and pressed against the opposing surface to complete the glued joint. As more particularly described in connection with FIG. 2, the spray head emits the atomized liquid spray in response to the supply of pressurized air through a solenoid control valve 15 to the head. When each box enters the spray station it passes a suitable sensor 16 which causes the spray head to initiate a spray cycle after the box has thereafter moved a predetermined distance and to terminate the spray cycle after the box has moved another predetermined distance. For most applications the glue is laid down in the form of a narrow line having a width determined by the spray pattern of the spray head 14 and a length determined by the duration of the spray cycle. An electric motor 18 is incorporated in the spray head 14 to automatically adjust the size of the spray orifice during the spray cycle so that the volume of glue being sprayed is proporational to the speed of the conveyor 12. Accordingly, when using the system of the present invention the amount of glue applied to the boxes is independent of the speed of which the boxes move past the head.

Figure 2:
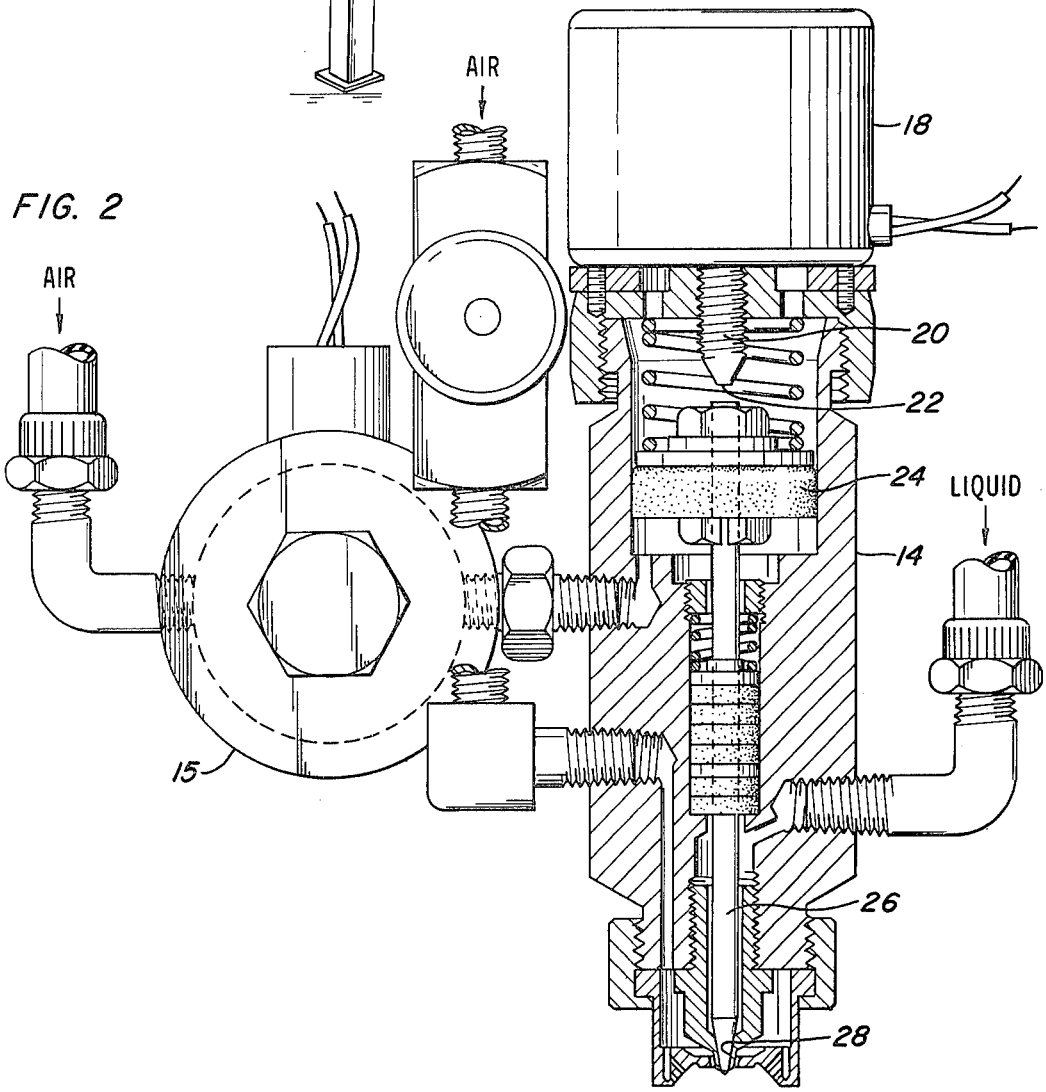
FIG. 2 is a perspective view of a liquid spray head incorporating means for automatically controlling the orifice opening in response to an electric signal applied thereto.

Refer now to FIG. 2 wherein the spray head 14 is shown in greater detail. The spray head 14 is substantially the same as that described in our copending application Ser. No. 530,615 filed Dec. 9, 1974 and reference thereto is suggested for a better understanding of the construction and operation of the spray head 14. The solenoid control valve 15 mounted to the head 14 controls the supply of pressurized air to the head to operate the head and spray liquid therefrom when the valve 15 is open. The motor 18 is preferably a series wound dc motor having its armature directly connected to a volume control screw 20 having a stop surface 22 at its forward end. When the head 14 is operated by opening the air inlet valve 15, the piston 24 is forced rearwardly against the stop surface. The needle valve 26, which is fixedly connected to the piston 24 is thus retracted from its seating position in the orifice 28 to permit the liquid glue to exit through the annular opening surrounding the conical surface of the needle valve. The axial position of the stop surface 22 thus determines the area of this annular opening and hence the rate of flow of the liquid glue from the nozzle.

Figure 3:
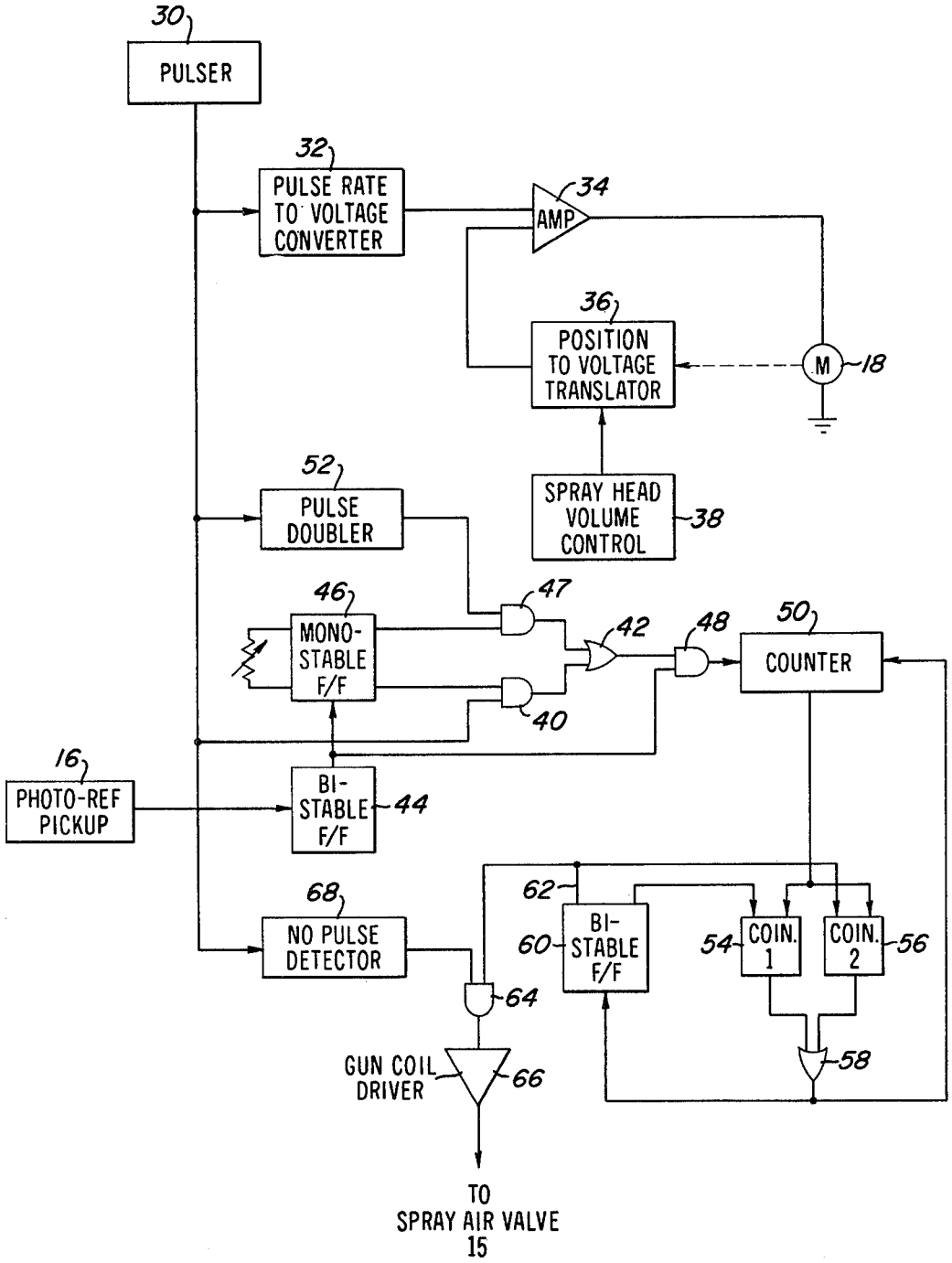
FIG. 3 is an electric control circuit, shown in schematic form, for use with the spray head of FIG. 2.

With reference to FIG. 3, a pulse generator 30 produces a pulse each time the conveyor 12 moves a predetermined distance of, for example, one-eighth inch. Preferably, the pulser is a photoreflective type which is driven in synchronism with the conveyor although any other suitable pulse generator may be used. The output voltage pulses from the pulser 30 are coupled to a converter 32 which provides a dc output voltage having a value proporational to the rate of the pulses from the pulser 30. This dc voltage is coupled to one input of a differential amplifier 34 having a second input to which a dc voltage is supplied from a position-to-voltage translator 36. The voltage level from the translator 36 is related to the position of the rotor of the motor 18. Consequently, when the input voltage from the converter 32 is equal to the output voltage from the translator 36 the output from the amplifier 34 is zero and the rotor of the motor 18 remains stationary. If, for example, the conveyor 12 speeds up, the pulse rate from the pulser 30 increases to cause the output voltage from the converter 32 to exceed that of the translator 36. Accordingly, the level of the output voltage from the amplifier 34 changes to cause the rotor of the motor 18 to rotate until the output from the amplifier 34 again equals that of the converter 32. That operation of the motor 18 retracts the stop surface 22 by a predetermined amount to increase the liquid flow rate from the head when the solenoid valve 15 opens. In a similar manner the stop surface 22 is moved forward when the conveyor 12 slows down and the pulse rate decreases correspondingly to reduce the liquid flow rate from the nozzle.

In order to adjust the flow rate of liquid glue through the spray head for any given position of the rotor of the motor 18, manually adjustable volume control means 38 is coupled to the translator 36. Preferably the control means 38 is a variable resistance which is used to adjust the voltage level of the output signal from the translator 36.

In order to time the sequential operation of the solenoid control valve 15 so as to lay down a stripe of predetermined length and location on the surface to be glued, the output pulses from the pulser 30 are coupled to a solid state control circuit which operates the valve 15. As shown, the output pulses from the pulser 30 is connected to one input of an AND gate 40 which feeds an OR gate 42 when the second input goes HI in response to a box being sensed by the photo sensor 16. When the sensor 16 senses a box it causes a bistable flip-flop 44 to shift from one state to the other, and the output of the flip-flop 44 is fed through a mono-stable flip-flop 46 to either the AND gate 40 or to another AND gate 47. When coupled to the AND gate 40, it opens the AND gate 40 to permit the pulses from the pulser 30 to pass through the OR gate 42 to an AND gate 48 which feeds the counter 50. It may be seen that the flip-flop 44 profices an input signal to the other input of the AND gate 48. When the flip-flop 46 is in the other state, pulses from a pulse doubler 52 are coupled through the AND gate 47, the OR gate 42 and the AND gate 48 to the counter 50. The latter condition is used where greater precision of the glue pattern is required.

The output of the counter 50 is coupled to each of a pair of coincidence circuits 54 and 56 having their respective outputs coupled to the two inputs of an OR gate 58. The output of the OR gate is coupled to the reset input of the counter 50 and resets the counter each time an input from the OR gate 58 occurs. In addition, the output of the OR gate 58 causes a bistable flip-flop 60 to change state. When the flip-flop 60 changes state the output terminal 62 goes HI and passes through an AND gate 64 and an amplifier 66 to the solenoid of the valve 15 to open the valve and initiate the spray cycle. The other input to the AND gate 64 remains HI as long as pulses are generated by the pulser 30. Should the conveyor stop, for example, the output of the no pulse detector 68 goes LO and the valve 15 closes if it was open or remains closed if it was closed. The outputs from the bistable flip-flop are also used to gate one of the other of the coincidence circuits 54 and 56 on.

Considering the operation of the air valve control circuit, let it be assumed that the conveyor is moving and a box is entering the spray station. When the box arrives at the sensor 6, the output from the flip-flop 44 goes HI to cause the pulses from either the pulser 30 or from the pulse doubler 52 depending on the manual setting of the flip-flop 46 to drive the counter 50. The coincidence circuit is manually adjusted to provide an output when the box is moved a predetermined distance past the sensor 16. When the pulses counted equals the number set in the coincidence circuit 54, the output of the coincidence circuit 54 goes HI and triggers the flip-flop 60 thereby to open the air valve 15 and initiate a spray cycle. Also, the counter 50 is reset by the output from the OR gate 58.

The counter 50 thus commences a second count until the number of pulses counted equals the number set in the coincidence circuit 56. When coincidence occurs, the output from the coincidence circuit 56 goes HI to reset the counter 50 and trip the flip-flop 60 to its other state thereby closing the air valve 15. Since the pulses are generated by the pulser 30 in response to incremental movement of the conveyor, and these pulses are the clock pulses of the control system, variations in the speed of the conveyor do not alter the length or position of the glue pattern deposited on the box.

Although there is a constant time delay between opening the valve 15 and laying down the pattern, this period is so short as to have no noticeable affect on the position of the pattern within the ranges of conveyor speeds generally encountered in packaging and box making lines. However, if found to be necessary or desirable, there may be provided an anticipating circuit which utilizes the output from the converter 32 to vary the setting of the coincidence circuits 54 and 56 in reverse relationship to the level of the output voltage from the converter 32. When, therefore, the conveyor speed substantially increases the spray head will operate, for example, one pulse sooner to cause the glue pattern to begin at a desired location on the box.

While the present invention has been described in connection with a gluing system it has other applications such, for example, as in high speed coating, painting and printing systems. Therefore, it is intended by the appended claims to cover all such changes and modifications which come within the true spirit and scope of this invention.

What is claimed is:

1. A method of controlling the operation of a device for applying liquid in a predetermined pattern to a moving surface, comprising mounting a liquid applying device in a fixed position along the path of travel of said surface, feeding liquid from said device to said surface as said surface moves past said device, generating a pulse for each predetermined increment of movement of said surface, counting said pulses and controlling the initiation and termination of the feeding of liquid from said device to said surface in response to predetermined respective counts of said pulses, and varying the flow rate at which liquid is fed from said device to said surface in response to changes in the rate at which said pulses are generated.

* * * * *